United States Patent [19]

Morgan

[11] 4,234,126

[45] Nov. 18, 1980

[54] BALANCED, REACTION IMPACT SPRINKLER

[75] Inventor: Norman D. Morgan, Pasadena, Calif.

[73] Assignee: Rain Bird Sprinkler Mfg. Corp., Glendora, Calif.

[21] Appl. No.: 28,708

[22] Filed: Apr. 10, 1979

Related U.S. Application Data

[63] Continuation-in-part of Ser. No. 843,711, Oct. 20, 1977, abandoned.

[51] Int. Cl.[3] ..... B05B 3/00

[52] U.S. Cl. ..... 239/230

[58] Field of Search ..... 239/230–233, 239/240, 241, 243, 245

[56] References Cited

U.S. PATENT DOCUMENTS

| | | | |
|---|---|---|---|
| 2,904,261 | 9/1959 | Johnson | 239/230 |
| 4,055,304 | 10/1977 | Monson | 239/230 |

FOREIGN PATENT DOCUMENTS

| | | | |
|---|---|---|---|
| 165330 | 9/1955 | Australia | 239/230 |
| 511899 | 4/1955 | Canada | 239/230 |
| 552874 | 12/1956 | Italy | 239/230 |
| 502626 | 4/1976 | U.S.S.R. | 239/230 |

*Primary Examiner*—Andres Kashnikow
*Assistant Examiner*—Gene A. Church
*Attorney, Agent, or Firm*—Fulwider, Patton, Rieber, Lee & Utecht

[57] ABSTRACT

An improved water sprinkler of the impact-arm type is provided in which nozzle reaction forces, impact arm acceleration forces and gravitational forces are completely balanced by the use of at least two diametrically opposed nozzles, and two diametrically opposed impact arms mounted for movement as a single unit.

10 Claims, 6 Drawing Figures

FIG. 1.
PRIOR ART
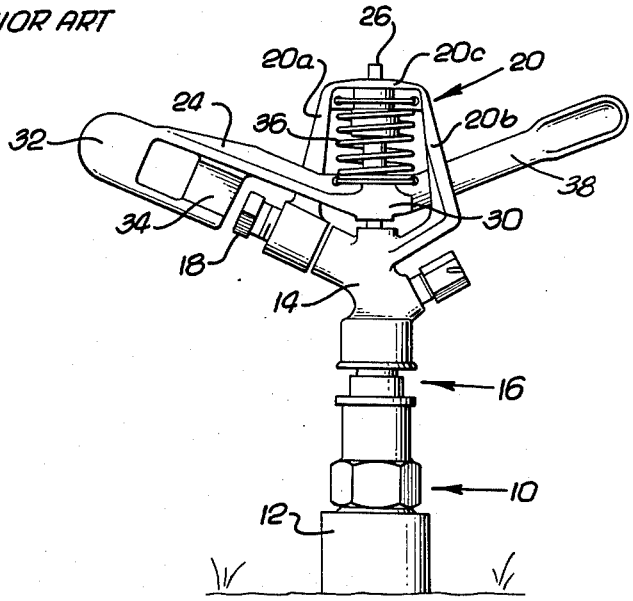
FIG. 3.
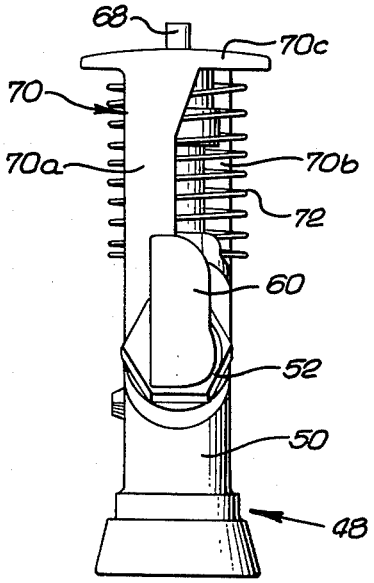
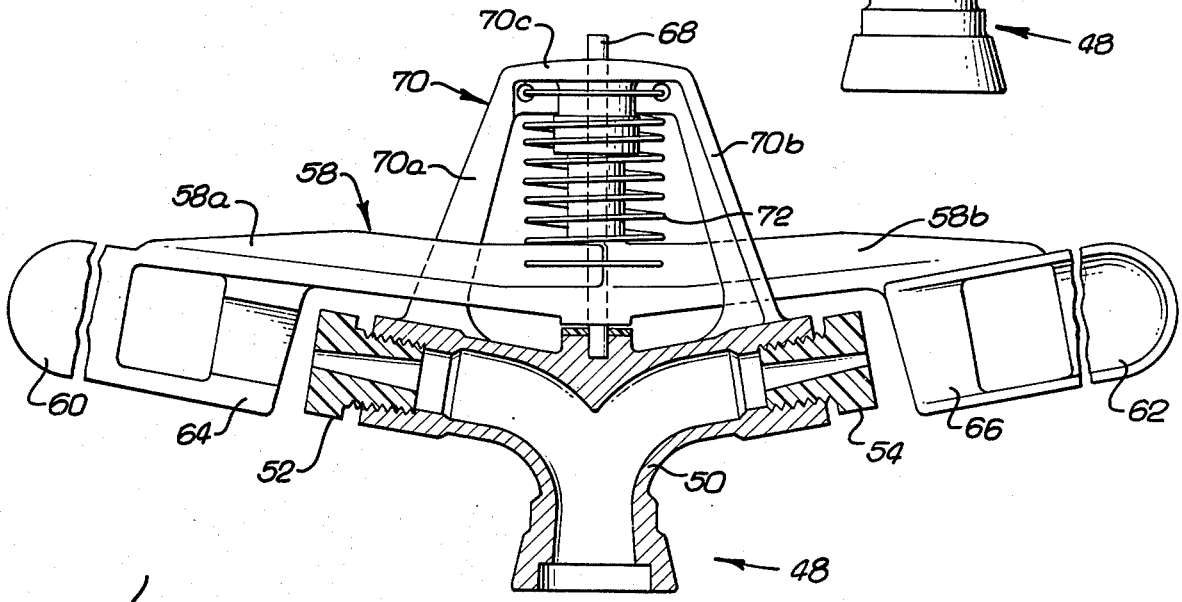
FIG. 2.

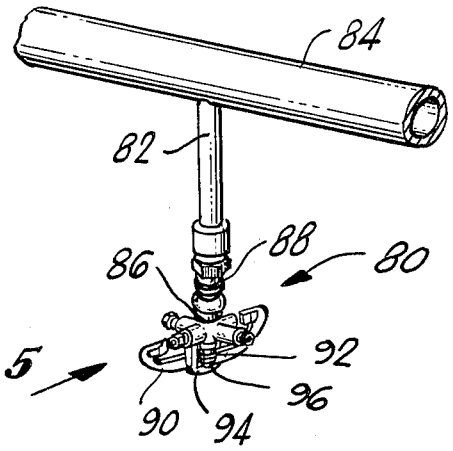
Fig. 4
Fig. 5
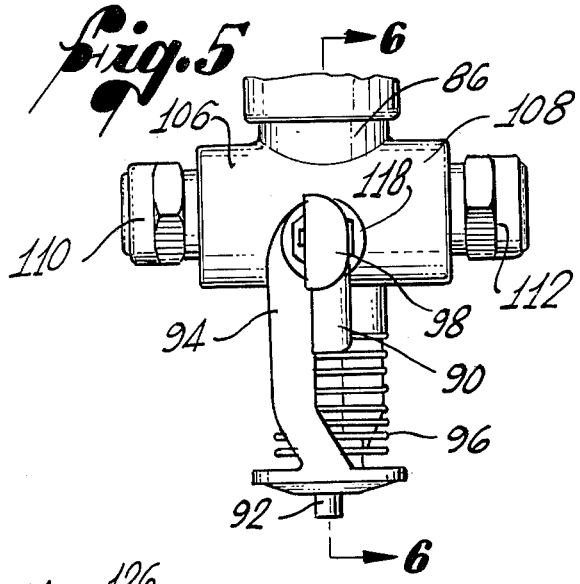
Fig. 6
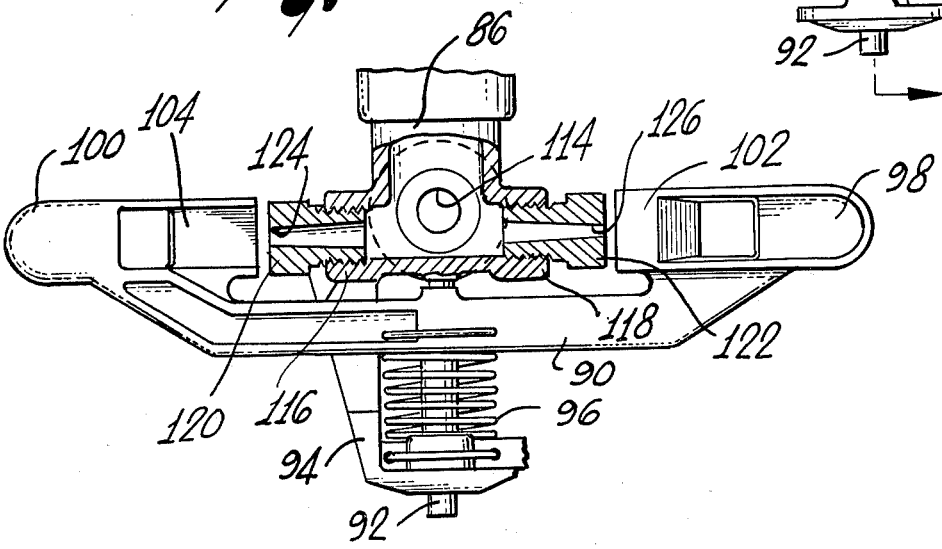

BALANCED, REACTION IMPACT SPRINKLER

This application is a continuation-in-part of co-pending application Ser. No. 843,711, filed Oct. 20, 1977, and now abandoned.

BACKGROUND OF THE INVENTION

The present invention relates generally to water sprinklers of the impact-arm type, and, more particularly, to impact-arm sprinklers for full-circle rather than part-circle watering.

Typically, an impact-arm sprinkler has a hollow sprinkler body for supplying water from a substantially vertical riser pipe to a nozzle which is mounted on the body at an angle of approximately 10 to 30 degrees above the horizontal. The sprinkler body is mounted on a sprinkler mounting bearing, for rotation about a substantially vertical axis, and an impact arm is mounted for rotation with respect to the sprinkler body, about the same vertical axis. A torsional spring urges the impact arm against a stop affixed to the sprinkler body, and, in this position, a deflector spoon on the impact arm is located directly in the stream of water flowing from the nozzle. The impact arm is thereby deflected by the stream of water, and is rotated, compressing the torsional spring. The force of the spring slows and then reverses the rotation of the impact arm, driving it against the stop on the sprinkler body, and thereby applying an impulse of angular acceleration to the body. The impact arm is repeatedly deflected by the stream of water from the nozzle, and continues to oscillate angularly in this manner, applying an impulse of angular acceleration to the sprinkler body on each cycle of its oscillation.

Although the impact arm is usually balanced, in the sense that it has its center of gravity aligned with its axis of rotation, the deflection force applied to the impact arm by the stream of water is necessarily asymmetrical with respect to the axis of rotation. The force of the stream impinging on the deflector spoon has one horizontal component of force tending to rotate the impact arm about its axis, and has in addition a second horizontal component and a vertical component, both acting in the same plane as the axis of rotation, and both having a tendency to induce wear in the bearing surfaces between the impact arm and the sprinkler body. Even the horizontal component which induces rotation of the arm is not a pure torque force, and results in an asymmetrical reaction force at the impact-arm bearing. The problem is further compounded by the transmission of these asymmetrical forces to the sprinkler mounting bearing connecting the sprinkler body to the stationary water supply pipe.

Further asymmetry results from nozzle reaction forces on the sprinkler body. Flow of water through the nozzle, quite apart from the action of the impact arm, produces vertical and horizontal components of a reaction force, both acting in the vertical plane through the nozzle and its axis of rotation. Again, these asymmetrical forces result in sometimes rapid wear of the bearing surfaces of the bearing on which the sprinkler body is mounted. Moreover, water used for irrigation often contains abrasive silt and sand that can accelerate the wear of both the sprinkler mounting bearing and the impact-arm bearing.

In certain applications, it is desirable to place an irrigation sprinkler at the top of a very tall riser, as for example, when irrigating a fruit crop, such as citrus trees or when used for frost protection. Further, quite frequently such sprinklers are disposed on a relatively long riser which projects downwardly from a supply conduit, such as when used with some center pivot type irrigation systems. It will be appreciated that any non-axial forces generated by a sprinkler disposed on the end of a relatively long riser can result in undesirable vibration and fatigue problems in the riser and its supporting water supply conduit.

Another disadvantage of prior art impact-arm sprinklers is that, when such sprinklers are mounted on sloping ground with the axis of rotation tilted away from the vertical, the speed of rotation is affected by gravitational forces acting on the sprinkler body, and varies cyclically as the sprinkler rotates. Accordingly, there has long been a need in the field of impact-arm sprinklers, for a sprinkler assembly which balances the nozzle reaction forces and impact arm acceleration forces, thereby reducing wear in the bearings of the assembly, and which may be used on sloping terrain without variations in the speed of rotation. The present invention fulfills these needs.

SUMMARY OF THE INVENTION

The present invention resides in an impact-arm sprinkler of symmetrical construction, having diametrically opposed nozzles, and an impact arm having symmetrical deflector spoons mounted at the ends thereof for interaction with the respective streams of water from the two nozzles. The forces acting on the deflector spoons of the impact arm are thereby perfectly balanced, resulting in a pure torque force about the axis of rotation, together with a component of force along the axis of rotation, but no unbalanced forces tending to induce wear in the sprinkler bearings.

Similarly, the nozzle reaction forces from the two nozzles balance each other in the horizontal or radial direction, and the vertical components result in a purely axial reaction along the axis of rotation. Again, there are no unbalanced nozzle reaction forces tending to induce wear in the bearings. As a consequence of the novel construction of the present invention, both the sprinkler mounting bearing and the impact-arm bearing last much longer than in conventional sprinklers. In addition, the sprinkler may be mounted on a hillside where the riser pipe is tilted away from the vertical direction, since there will be no unbalanced gravitational forces acting on the sprinkler body.

In an application where the sprinkler is mounted at the end of a drop line riser which depends downwardly from a water supply conduit, as is often the case on a pivot-move type of irrigation system, the diametrically opposed nozzles can be arranged at a 90 degree angle from the vertical axis of the sprinkler to eject water horizontally. With this arrangement, the adverse effect of wind drift is minimized. If desired, a second set of opposed nozzles can be provided on the sprinkler along a horizontal axis perpendicular to the axis of the first pair of nozzles. The second set of nozzles can be arranged to eject water a greater distance from the sprinkler than the water ejected from the first set, and the drive arm associated with the first set of nozzles is capable of driving the sprinkler properly without interfering with the stream of water ejected from the second set of nozzles.

Other aspects and advantages of the invention will become apparent from the following more detailed description, taken in conjunction with the accompanying drawings which illustrate, by way of example, the principles of the invention.

BRIEF DESCRIPTION OF THE DRAWINGS

FIG. 1 is an elevational view of a typical impact-arm sprinkler of the prior art;

FIG. 2 is a fragmentary elevational view, partly in section, of an impact-arm sprinkler embodying the present invention;

FIG. 3 is an end-elevational view of the sprinkler of FIG. 2;

FIG. 4 is a fragmentary, perspective view of an alternative embodiment of an impact-arm sprinkler embodying the present invention;

FIG. 5 is an enlarged, fragmentary elevational view of the impact-arm sprinkler illustrated in FIG. 4, and taken generally in the direction of the arrow 5 in FIG. 4; and FIG. 6 is a fragmentary, elevational view, partly in section, of the impact-arm sprinkler illustrated in FIGS. 4 and 5, taken generally along the line 6—6 in FIG. 5.

DETAILED DESCRIPTION

As shown in the drawings for purposes of illustration, the present invention is principally concerned with impact-arm sprinklers, and with an improved impact-arm sprinkler having no asymmetrical forces acting on its bearings. The sprinkler can be made from any suitable material. Preferable materials are metal or plastic.

As shown in FIG. 1, a conventional impact arm sprinkler comprises a threaded adapter, indicated by reference numeral 10, for attachment to a threaded, substantially vertical riser pipe 12 (not shown), and a sprinkler body 14 journaled for rotation on a lower bearing 16 with respect to the adapter 10 and the riser pipe 12. A nozzle 18 is attached to the sprinkler body 14, and receives water supplied through the body from the riser pipe 12. The nozzle is typically directed at an angle of 10 to 30 degrees to the horizontal, and is usually replaceable in the event of wear, or to provide for different types of spray coverage. Integral with the sprinkler body 14 is a bridge portion 20 extending upwardly from the body. The bridge portion 20 has a first sideleg 20*a* which extends upwardly from a point on the body close to the nozzle 18, a second sideleg 20*b* located diametrically opposite the first, and a top member 20*c* connecting and integral with the two sidelegs.

An impact arm 24 is mounted for rotation about a vertical axis with respect to the sprinkler body 14. In particular, the impact arm 24 is journaled for rotation about a shaft 26 which extends upwardly from the sprinkler body 14, to an appropriate hole in the top member 20*c* of the bridge portion 20. The impact arm 24 has an integral hub 30 by which it is mounted for rotation about the shaft 26, and extends above and generally parallel with the direction of the water stream emerging from the nozzle 18. At the end of the impact arm 24 is a deflector spoon 32 which depends downwardly from the arm, directly in the path of the water stream. Also depending from the arm 24, at a position closer to the nozzle than the deflector spoon, is a vane 34. The stream of water from the nozzle 18 passes to one side of the vane 34, and then strikes the concave surface of the spoon 32, to deflect the impact arm angularly about its axis of rotation.

A torsional spring 36 is mounted about the central hub 30 of the impact arm 24, and is connected by one end to the bridge 20 and by its other end to the impact arm. The spring 36 urges the impact arm 24 against one face of the first bridge sideleg 20*a*. In this position, the impact arm has its deflector spoon 32 located in the path of the water stream. The weight of the impact arm 24 is usually counter-balanced by an opposing arm 38 extending from the hub 30 in a direction diametrically opposite to that of the impact arm. It will be apparent that, when water is sprayed through the nozzle 18, there is a nozzle reaction force which may be resolved into horizontal and vertical components. Both components of this nozzle reaction force tend to rotate the sprinkler body 14 about a horizontal axis, and are resisted by equal and opposite reactions at the lower bearing 16. Thus, the nozzle reaction forces are likely to result in substantial wear at the lower bearing.

Furthermore, when water impinges upon the vane 34 and the spoon 32 of the impact arm 24, the resultant force acting on the impact arm may be resolved into three components. There is the desired horizontal component tending to rotate the arm, and a second horizontal component and a vertical component which both act in the same plane as the impact arm 24 and its axis of rotation. The second horizontal component and the vertical component are resisted by equal and opposite reactions at the central hub 30 as it bears on the shaft 26. These reaction forces are, in turn, transmitted to the lower bearing 16, again adding to the likelihood of wear.

In accordance with the present invention, a modified sprinkler body 48 (FIG. 2) having a bifurcated upper portion 50 to which two nozzles 52 and 54 are affixed, is journaled for rotation on a lower bearing (not shown) in the same manner as the prior art sprinkler described above. An impact arm 58 having two diametrically opposed portions 58*a* and 58 *b*, two deflector spoons 60 and 62, and two corresponding vanes 64 and 66, is mounted for rotation on a central shaft 68, corresponding to the shaft 26 of the prior art sprinkler. A bridge portion 70, having sidelegs 70*a* and 70*b* and a top member 70*c*, is formed integrally with the bifurcated sprinkler body 50, and, as in the prior art design, is utilized to provide a stop for the angular movement of the impact arm 58. A torsional spring 72 urges the impact arm 58 against the bridge portion 70, and the arm is deflected therefrom by water streams from the nozzles 52 and 54, in the same manner as described for the prior art sprinkler.

It will be appreciated that the invention provides for complete balancing of both the nozzle reaction forces and the forces acting on the impact arm 58. As to the nozzle reaction forces, the horizontal components at each nozzle are equal in magnitude and opposite in direction, resulting in cancellation of these components. The vertical components of the nozzle reaction forces will be equal in magnitude and in the same direction at each nozzle, so that there will be no torsional force applied to the sprinkler body 50, only a net vertical force directed along the axis of rotation.

With regard to the forces applied by the water stream to accelerate the impact arm 58, it will be apparent that the horizontal components of force applied to each deflector spoon, to accelerate the arm angularly, will be equal in magnitude, so that a pure torque will be applied to the symmetrical arm. As to the other horizontal and vertical components of force acting in the same plane as the axis of rotation, the horizontal forces will be equal in magnitude and opposite in direction and will therefore be self-cancelling. The vertical components will be equal in magnitude and direction, but will induce no rotational torque, merely a net vertical force along the axis of rotation. Consequently, only axial forces will be applied to both sprinkler bearings, and the wear on the bearings will therefore be considerably reduced as compared with the wear in the bearings of a conventional impact-arm sprinkler.

Another advantage of the sprinkler of the present invention is that it may be installed on a hillside, with its axis of rotation inclined from the vertical, and yet the speed of rotation of the sprinkler will remain uniform, since the gravitational forces acting on the two sides of the sprinkler body are always in balance.

An example of an alternative embodiment of the sprinkler of the present invention is illustrated in FIGS. 4 through 6. As can best be seen in FIG. 4, a balance reaction impact-arm sprinkler, indicated generally by reference numeral 80, is shown mounted at the lower end of a drop line 82 depending from a water supply conduit 84. The supply conduit 84 can be, for example, part of a conventional pivot-move irrigation system employing a number of full-circle, impact-arm sprinklers 80 depending from the conduit 84 along the length thereof. Of course, the sprinklers 80 could be mounted on risers (not shown) extending upwardly from the conduit 84, if desired.

The sprinkler 80 includes a body 86 which is mounted on a bearing 88 for rotation with respect to the drop line 82. In this instance, the body 86 includes four irrigation water outlets projecting outwardly from the body in a plane perpendicular to the vertical axis of the sprinkler 80, and the four water outlets are evenly spaced around the sprinkler 80 forming two pairs of diametrically opposed outlets.

A balanced, double-ended impact arm 90 is mounted on the sprinkler 80 for rotation about a central vertical pin 92. The arm 90 extends between the sidelegs of a bridge 94 and is biased into contact with the sidelegs by a torsional spring 96. Two oppositely facing deflector spoons 98 and 100 (FIG. 6) are mounted at opposite ends of the impact arm 90, and the spoons, together with two corresponding vanes 102 and 104, are imposed directly in the path of the streams of water ejected from one of the pairs of diametrically opposed outlets.

In the sprinkler 80, each of the outlets from the body 86 is provided with a removable nozzle. It is important for the purposes of this invention that each pair of diametrically opposed outlets be provided with the same size nozzle so that the nozzle reaction forces will be properly balanced, as described above in connection with the sprinkler of FIGS. 2 and 3. If desired, one of the pairs of outlets can be arranged with nozzles having relatively small openings for irrigating the region adjacent the sprinkler, and the other pair of outlets can be arranged with nozzles having larger openings to eject irrigation water farther from the sprinkler.

Toward this end, as can best be seen in FIG. 5, the body 86 has a pair of diametrically opposed outlets 106 and 108 each having a removable nozzle 110 and 112 secured therein. The nozzles 110 and 112 have identical nozzle openings 114 (FIG. 6) to achieve the desired balancing of nozzle reaction forces as described above. The other pair of diametrically opposed outlets 116 and 118 can best be seen in FIG. 6, and are each provided with a removable nozzle 120 and 122. The nozzles 120 and 122 have identically sized nozzle openings 124 and 126, and in this instance, the openings 124 and 126 are shown as being smaller than the openings 114 in the nozzles 110 and 112.

With this arrangement, the impact arm 90 is driven by the streams of water directed from the smaller nozzles 120 and 122 impinging on the spoons 98 and 100 for driving the sprinkler 80, and the streams ejected from the larger nozzles 110 and 112 are permitted to flow uninterrupted by any drive mechanism. Toward this end, the spring 96 is chosen to be strong enough to prevent the impact arm 90 from rotating far enough out of the streams ejected from the nozzles 120 and 122 to impinge upon the streams flowing from the larger nozzles 110 and 112. Alternatively, a mechanical stop (not shown) can be provided on the body 86 for the same purpose.

As illustrated, the axis of the diametrically opposed outlets 106 and 108 is vertically offset by a small distance from the axis of the outlets 116 and 118. If desired, all four of the outlets 106, 108, 116 and 118 can be arranged in the same horizontal plane. Moreover, the outlets are shown as being arranged to eject water outwardly at an angle of 90 degrees to the axis of the drop line 82, but it will be apparent that any desired stream trajectory can be chosen, so long as the diametrically opposed outlets are arranged symmetrically to balance the nozzle reaction forces, as provided by the present invention.

From the foregoing, it will be appreciated that, as is true with the sprinkler described in connection with FIGS. 2 and 3, the sprinkler 80 provides for complete balancing of both the nozzle reaction forces and the forces acting on the impact arm 90. Accordingly, it will be apparent that the invention described and claimed herein represents a significant advance over conventional impact-arm sprinklers having only one nozzle and one impact arm.

While several particular forms of the invention have been illustrated and described, it will also be apparent that various modifications can be made without departing from the spirit and scope of the invention.

I claim:

1. A water sprinkler of the impact-arm type comprising:

a bifurcated sprinkler body having a substantially vertically oriented intake portion and two symmetrically arranged diametrically opposed discharge portions adapted to receive two nozzles, said sprinkler body being mounted for rotation in a first angular direction about a substantially vertical axis an impact arm mounted on said sprinkler body for rotation about the same axis as said body, said impact arm having two diametrically opposed portions carrying oppositely facing deflector spoons at the ends thereof;

torsional spring means connected between said impact arm and said sprinkler body to urge said impact arm in said first angular direction; and abutment means affixed to said body, to limit rotation of said impact arm in said first angular direction;

whereby said deflector arm is deflected in a second angular direction opposite said first angular direction by impingement of water on said oppositely facing deflector spoons, and returns, under the influence of said spring, to impact said abutment means and drive said sprinkler body in said first angular direction, and whereby non-axial nozzle reaction forces or impact arm acceleration forces, and unbalanced gravitational forces acting on the sprinkler are substantially eliminated.

2. A water sprinkler as set forth in claim 1, wherein said abutment means is a bridge portion integral with said sprinkler body, said bridge portion having two upstanding legs and a connecting top member, and wherein said impact arm is mounted for rotation within said bridge portion.

3. In an impact-arm water sprinkler having a sprinkler body, nozzle means, and a spring-biased impact arm which is repeatedly deflected by a water stream and then returns by spring force to impact the sprinkler body and incrementally rotate it, the improvement wherein:

said nozzle means includes two symmetrically arranged, diametrically opposed nozzles;

said sprinkler body is bifurcated to provide for connection to said two nozzles, to produce two diametrically opposed streams of water; and said impact arm has two diametrically opposed portions which move in unison to rotate said body, said diametrically opposed portions carrying oppositely facing deflector spoons at the ends thereof;

whereby nozzle reaction forces and impact arm acceleration forces are completely balanced and non-axial components, and unbalanced gravitational forces acting on the sprinkler body are substantially eliminated.

4. A water sprinkler as set forth in claim 1 further including two additional diametrically opposed discharge portions arranged symmetrically about said substantially vertical axis.

5. A water sprinkler as set forth in claim 4 wherein said two additional discharge portions are adapted to eject water from said sprinkler along an axis substantially perpendicular to said substantially vertical axis.

6. A water sprinkler as set forth in claim 4 wherein all four of said discharge portions are adapted to eject water from said sprinkler in a plane substantially perpendicular to said substantially vertical axis.

7. In an impact arm irrigation sprinkler having a sprinkler body, nozzle means, and a spring-biased impact arm which is repeatedly deflected by a stream of water ejected from said nozzle means and then returns by spring force to impact the sprinkler body and incrementally rotate it about an axis, the improvement wherein:

said nozzle means includes a first set of two symmetrically arranged, diametrically opposed nozzles for ejecting water supplied to said body;

said impact arm has two diametrically opposed portions carrying oppositely facing deflector spoons at the ends thereof which cooperate with the water ejected from said first set of nozzles to rotate said body about said axis; and said nozzle means further includes a second set of two symmetrically arranged, diametrically opposed nozzles for ejecting water supplied to said body;

whereby nozzle reaction forces and impact arm acceleration forces are completely balanced and non-axial components, and unbalanced gravitational forces acting on said body are substantially eliminated.

8. The improvement as set forth in claim 7 wherein said second set of nozzles is arranged in a plane perpendicular to a plane including said axis and said first set of diametrically opposed nozzles.

9. The improvement as set forth in claim 7 wherein said first set of diametrically opposed nozzles is adapted to eject water from said body along an axis substantially perpendicular to said axis of rotation of said body.

10. The improvement as set forth in claim 9 wherein said second set of diametrically opposed nozzles is adapted to eject water from said body along an axis substantially perpendicular to said axis of rotation of said body.

* * * * *